US005929882A

United States Patent [19]

Sharpe

[11] Patent Number: 5,929,882

[45] Date of Patent: Jul. 27, 1999

[54] APPARATUS FOR MAINTAINING HYDROSTATIC PRESSURE IN AN INK JET PRINTHEAD

[76] Inventor: Colin R. Sharpe, 855 Fulton St., South Elgin, Ill. 60177

[21] Appl. No.: 08/728,866

[22] Filed: Oct. 10, 1996

[51] Int. Cl.[6] ..... B41J 2/175

[52] U.S. Cl. ..... 347/85; 347/32

[58] Field of Search ..... 347/7, 20, 22, 347/29, 32, 84, 85, 86, 87

[56] References Cited

U.S. PATENT DOCUMENTS

| | | | |
|---|---|---|---|
| 4,700,205 | 10/1987 | Rich et al. | 347/6 |
| 4,731,639 | 3/1988 | Gutmann | 355/64 |

FOREIGN PATENT DOCUMENTS

| | | | |
|---|---|---|---|
| 0 237 787 A2 | 3/1986 | European Pat. Off. . | |
| 0733481 | 9/1996 | European Pat. Off. . | |
| 32 04 661 A1 | 2/1982 | Germany . | |
| 0237787 | 9/1987 | Germany | B41J 3/04 |
| 3-277555 | 12/1991 | Japan . | |

*Primary Examiner*—N. Le
*Assistant Examiner*—Anh T. N. Vo
*Attorney, Agent, or Firm*—Rudnick & Wolfe

[57] ABSTRACT

An ink supply system for an ink jet printing device in which the elevation of the ink reservoir is controlled as a function of the elevation of the printhead orifices. In a preferred embodiment, the ink reservoir is mounted on an elevating carriage which is mechanically linked to the printhead via a Bowden™ cable. The cable cooperates with a pulley on the printhead such that rotation of the printhead results in translational movement of the elevating carriage. The dimensions of the pulley are selected such that the elevational changes in the reservoir ink level correspond directly with the elevational changes in the printhead orifices. Thus, the hydrostatic pressure head at the printhead orifices remains constant as the printhead is rotated from its home position to the priming position.

8 Claims, 4 Drawing Sheets

APPARATUS FOR MAINTAINING HYDROSTATIC PRESSURE IN AN INK JET PRINTHEAD

FIELD OF THE INVENTION

The invention relates generally to the field of ink jet printing devices, particularly the field of drop-on-demand type printing devices. Specifically, the invention relates to an apparatus for maintaining substantially constant hydrostatic pressure at the orifices of a drop-on-demand ink jet printhead.

BACKGROUND OF THE INVENTION

Ink jet printers are in widespread use in addressing of mail pieces, i.e., projecting images down onto passing mail pieces, and container and package labeling. These applications require relatively large images and often incorporate a number of printheads, each having a plurality of nozzles and being about one inch long, to provide the necessary image size. Typically, the printheads are stationary, while the substrate, i.e. the top or side of a container, moves by on a conveyor belt past the printheads.

Ink jet printing is typically accomplished using one of two techniques: drop-on-demand or continuous stream. In both techniques, the ink jet printer creates very small liquid ink droplets used to form an image on a substrate. Drop-on-demand printing differs from continuous stream printing in that the former uses capillary forces to convey ink to the printhead nozzles and tiny variations in pressure at the printhead nozzle to produce droplets while the latter continuously pumps the ink to the nozzles. Precise control of the pressure at the printhead nozzle orifices is thus critical to the operation of drop-on-demand printers.

In drop-on-demand printing, ink is conveyed to the nozzle orifices by capillary action. Ink is supplied to each print head from a remote reservoir via a flexible capillary tube. The hydrostatic pressure of the ink at the nozzle orifices is a function of the elevation of the orifice with respect to the ink in the remote reservoir. It is also a function of the surface tension and density of the ink being used. Thus, when changes occur in the type of ink being used, in the elevation of the nozzle orifices, or in the ink level in the remote reservoir, variations in the hydrostatic pressure at the nozzle orifices are experienced. These variations include excess hydrostatic pressure, which results in "weeping" or leakage of ink from the orifices, and insufficient hydrostatic pressure (negative pressure that is too low) which results in retreat of the ink into the printhead orifice and/or the ingestion of air within the printhead. Hydrostatic pressure at the printhead orifices is usually maintained at a small negative pressure of about one to three inches of water. Negative pressure is achieved by locating the remote ink reservoir such that the top of the ink level (the plane of the top surface of the stored ink) in the reservoir is at a slightly lower elevation than the printhead orifices. The pressure pulses that produce ink droplets are usually induced by piezoelectric or thermal deformation of small chambers within the printhead, which cause droplets to issue from the tiny orifices. The presence of air within the printhead is undesirable because it affects droplet generation.

Air is purged from the printhead by first reorienting it such that the orifices are disposed upwardly and then flushing the printhead with ink. Re-orientation is also used to clean or service the printheads. Since printhead priming is a matter of routine service for most drop-on-demand printing devices, the printheads are often mounted in bearings that permit in situ rotation of the printhead. Rotation of the printhead, from a home position in which the orifices point downwardly to a priming position in which the orifices point upwardly, will change the elevation of the orifices by four to six inches. After the printhead nozzles are oriented upwardly, a positive pressure is applied to the ink (usually by way of a pump associated with the ink reservoir) to flush out the orifices such that any trapped air is expelled.

Priming and rotation of the printhead present a rather vexing problem: the ink reservoir level must be adjusted after the printhead is primed (and after the priming pump is turned off ) such that the proper hydrostatic pressure is maintained at the printhead orifices while the printhead is rotated back to its home position. As described above, while the printhead is rotated to expose the orifices, the elevation of the nozzle orifices, and thus the hydrostatic pressure, are changing. After the priming pump is turned off, adjustment of the reservoir ink level is necessary to prevent excess negative pressure, which will again draw air into the printhead. On the other hand, if the pump is kept running during printhead rotation, the printhead nozzles will flood with ink. Thus, the priming process is somewhat complex and requires the judgement of a skilled technician.

There are no known devices which specifically address the particular problems described above. Some prior art devices have addressed related problems in the general field of controlling hydrostatic pressure in an ink jet printer. For example, German patent application No. DE 32 04 661 A1 discloses a device which permits changes in the relative elevation of the ink reservoir or printhead in order to achieve a controlled amount of ink seepage from the orifices to prevent tip drying. European patent application No. EP 23 77 87 discloses an ink jet printing system that incorporates a suspension spring to adjust the height of the ink reservoir to maintain the hydrostatic pressure as the ink supply depletes. The prior art, however, has not addressed the specific problems associated with movement of the printhead orifices relative to the level in the ink reservoir during priming, adjustment, cleaning or other maintenance.

SUMMARY OF THE INVENTION

The present invention addresses the aforementioned and other problems in the prior art by providing an ink supply system in which the elevation of the ink reservoir, and the top level of the ink therein, is varied as a function of the elevation of the printhead orifices. In a preferred embodiment, the ink reservoir is mounted on an elevating carriage which is mechanically linked to the printhead via a Bowden™ cable. The cable cooperates with a pulley on the printhead such that rotation of the printhead results in corresponding movement of the elevating carriage. The configuration of the pulley is selected such that the elevational changes in the reservoir ink level correspond directly with the elevational changes in the printhead orifices. The hydrostatic pressure head at the printhead orifices thus remains within a predetermined range as the printhead is rotated from its operating position to the priming position, with the orifices exposed, and back again.

BRIEF DESCRIPTION OF THE DRAWINGS

The aforementioned and other objects of the invention will be fully understood through the following description and the accompanying drawings.

DETAILED DESCRIPTION OF THE INVENTION

Figure 1A:
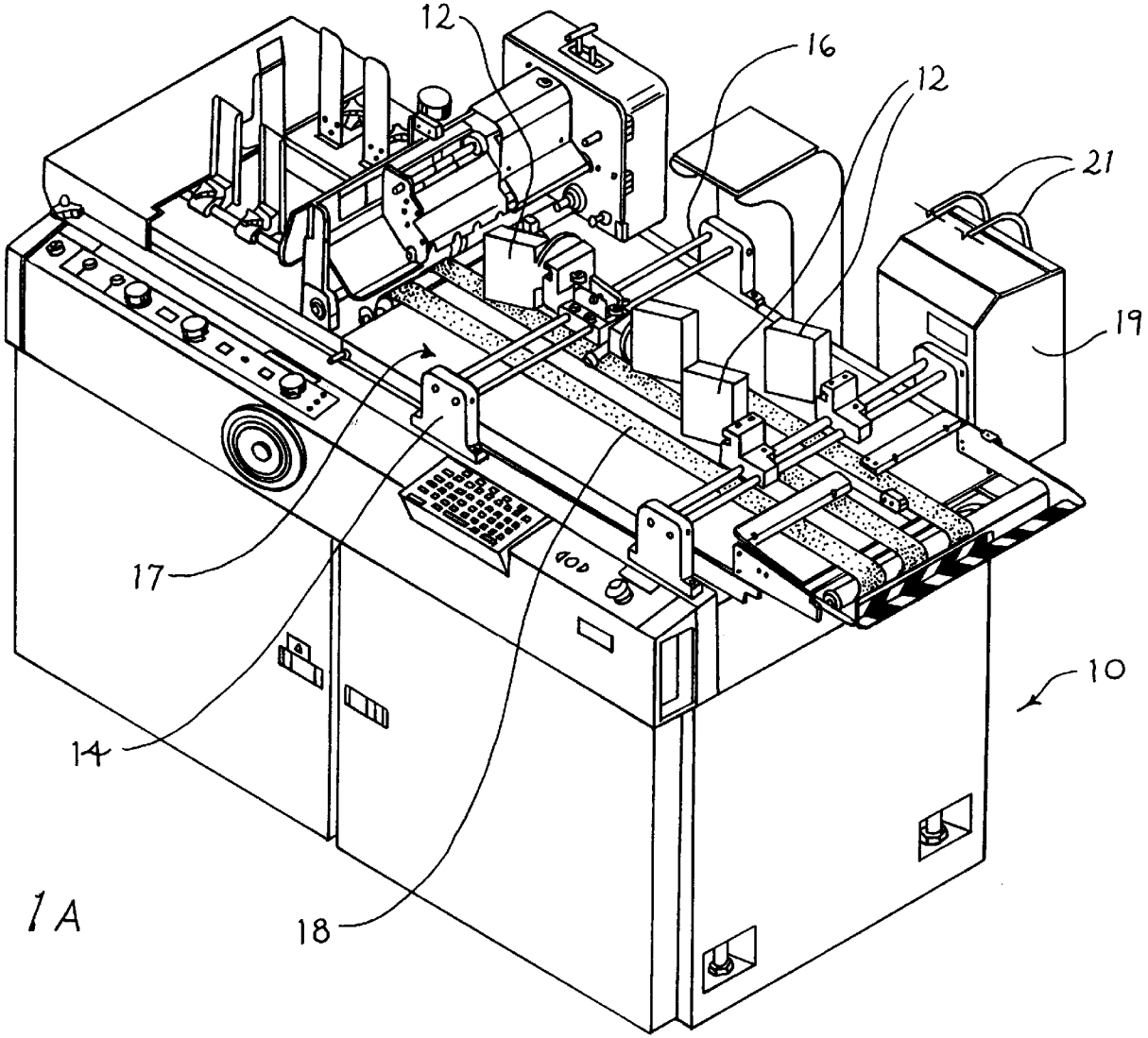
FIGS. 1A–1C illustrate an ink jet printing device to which the present invention may be adapted.
Figure 1B:
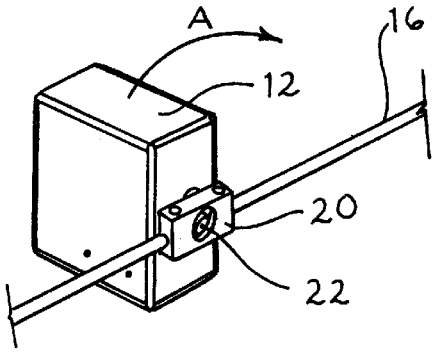
Figure 1C:
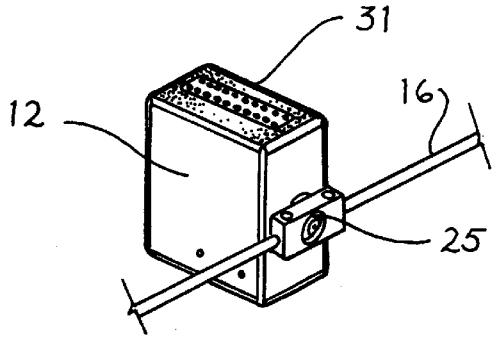

An ink jet printing device 10, suitable for implementing the present invention is illustrated in FIGS. 1A–1C. The device comprises a number of printheads 12 mounted in a known manner on laterally extending support rods 16. In the device shown, four printheads 12 are arranged to provide an image on mail pieces, such as envelopes or packages (not shown) which pass under the printheads 12 on transport surface 17 via conveyor belts 18. Printheads 12 remain stationary with respect to the moving mail pieces and the lateral position of the printheads on support rods 16, as well as the height of the printheads above the transport surface 17, may be adjusted in a known manner. The printheads 12 include journals 25 which are mounted in bearings 22 win support blocks 20 as shown in detail in FIGS. 1B and 1C. Bearings 22 permit rotation of the printheads 12 in the direction of arrow A, from a home position, shown in FIG. 1B, to a priming position shown in FIG. 1C, where the orifices 31 are facing upward in an exposed orientation. The mounting details illustrated in FIG. 1A should be ignored to the extent that they do not correspond with the details shown in FIGS. 1B and 1C.

Referring again to FIG. 1A, ink is supplied to printheads 12 from ink reservoirs which are housed in housing 19. Ink feed lines 21 (which are shown cut-off in FIG. 1A for clarity) extend from the reservoirs to the printheads 12, with a single reservoir and feed line assigned to each printhead 12. The printheads 12 are drop-on-demand type printheads that are commercially available, such as the Ultrajet printhead, sold by Trident, Inc.

Figure 3:
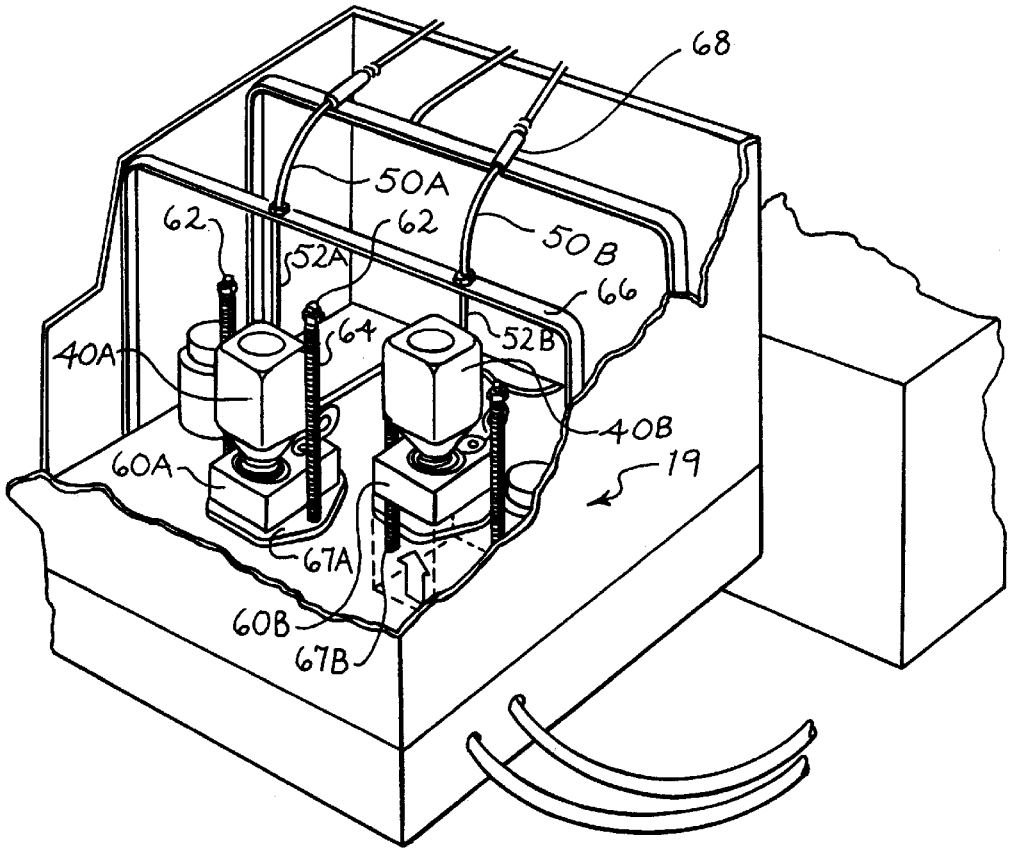
FIG. 3 illustrates an ink reservoir mounting configuration in accordance with a preferred embodiment of the invention.
Figure 2:
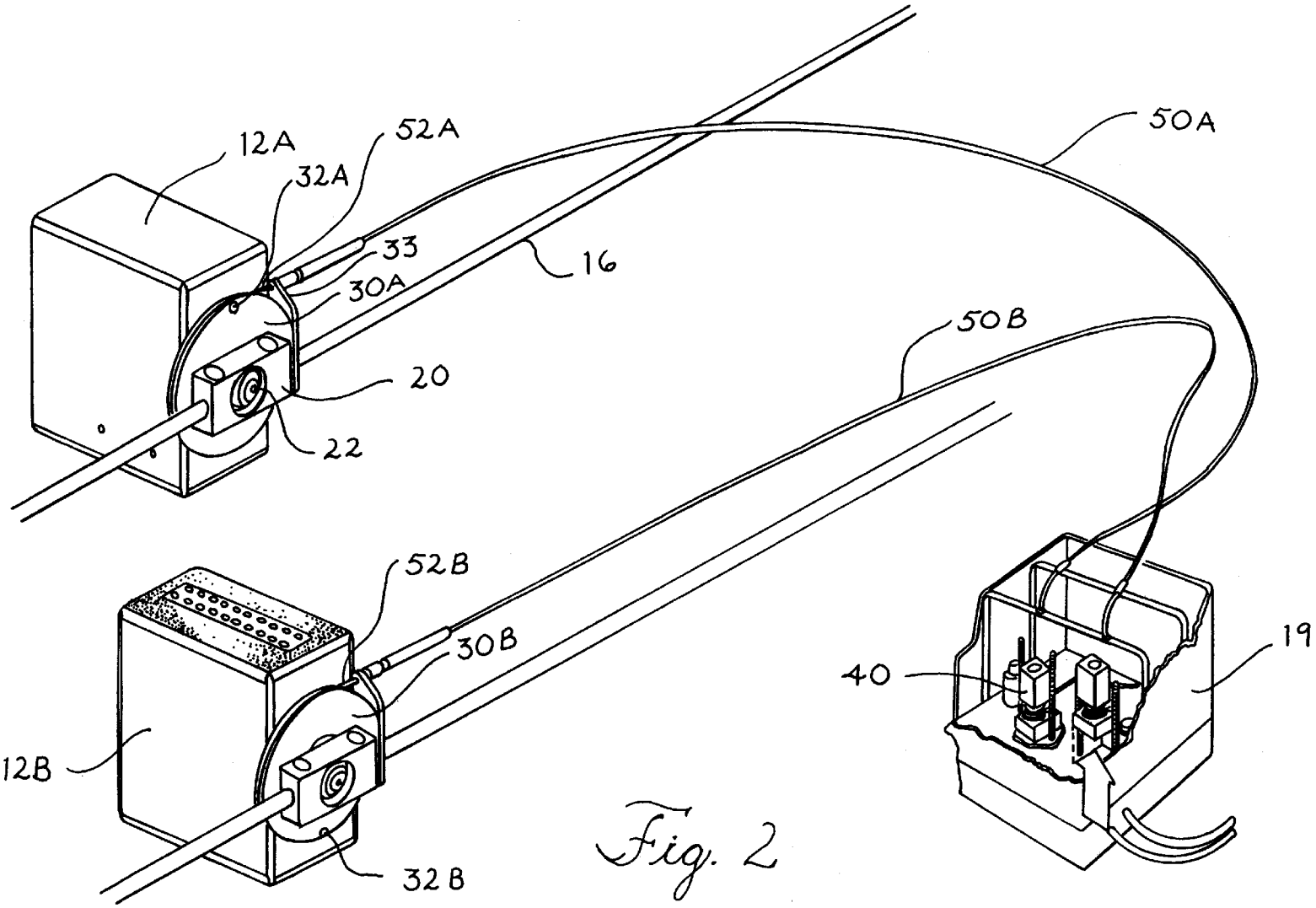
FIG. 2 illustrates a preferred embodiment of an ink jet printing device incorporating a linkage according to the present invention.
Figure 4:
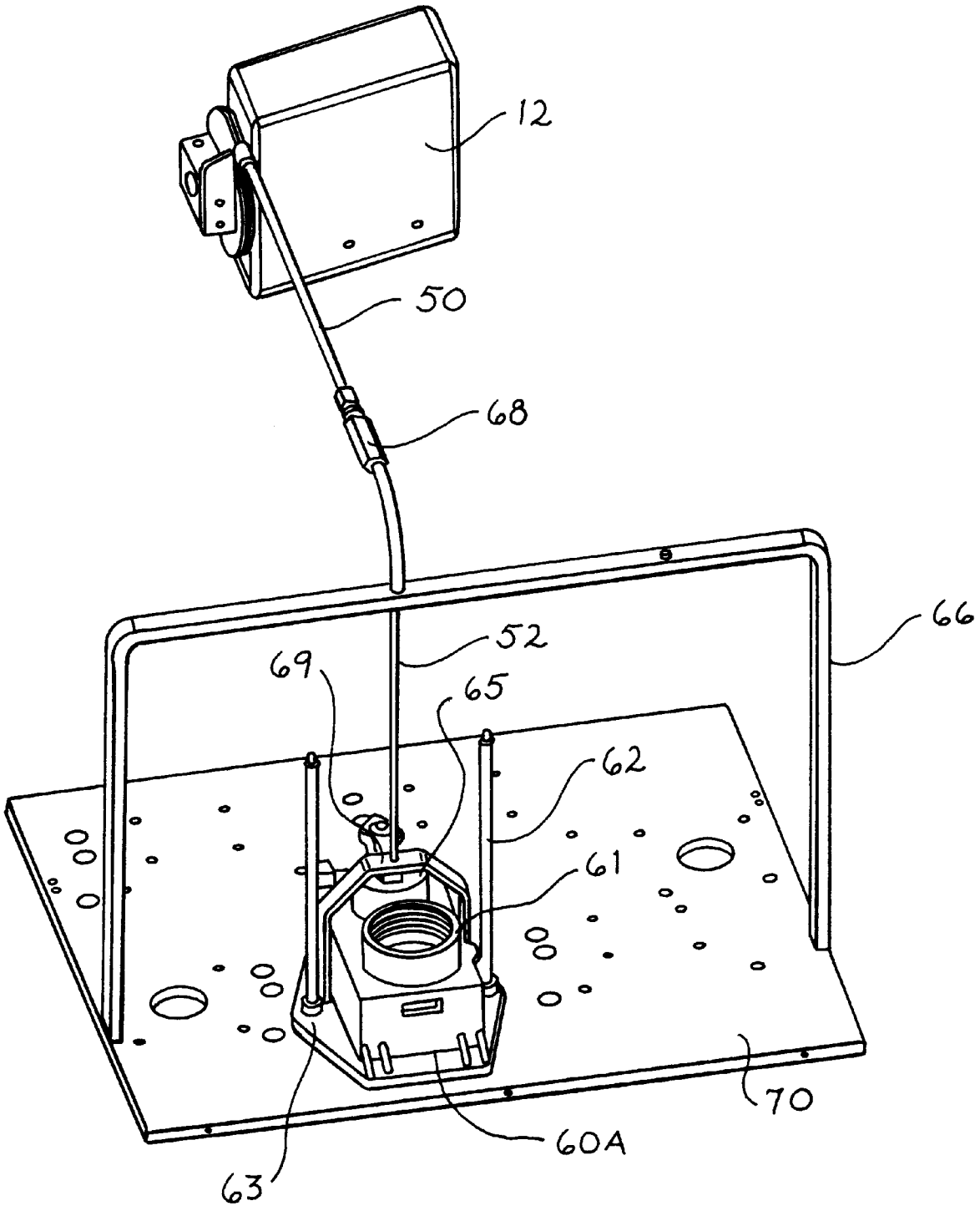
FIG. 4 illustrates the mechanical details of an ink jet printing device incorporating the present invention.

Referring to FIGS. 2–4, the present invention provides a system for automatically adjusting the height of ink reservoirs 40 when the printheads 12 are rotated. In FIG. 2, two printheads are illustrated, one in the ho me position 12A, and one in the priming or servicing position 12B. Each printhead is provided with a pulley 30A and 30B, respectively, which is attached to the printhead for rotation therewith. Separate Bowden™ cables 50A and 50B, which comprise a wire, usually made of spring steel and enclosed in a casing or sheath, are independently attached to the pulleys 30A and 30B, respectively, via tab m embers 32A and 32B which are attached to the individual wires 52A and 52B of the Bowden™ cables 50A and 50B. The outer sheath of the Bowden™ cable is secured to the mounting block 20 via bracket 33. Thus, rotational movement of printhead 12 results in translation of the wires 52A and 52B within the casing and vertical movement of ink reservoir 40 as will be explained below.

Referring to FIG. 3, the opposite respective ends of wire 52A and 52B are secured to movable carriages 60A and 60B, which are mounted for vertical sliding movement on guide posts 62. Each carriage 60A and 60B includes a lower flanged portion 67A and 67B, respectively, which is provided with a pair of guide holes (not visible in FIG. 3) that receive guide posts 62. Coil springs 64 surround each guide post 62 and abut lower flanged portion 67 to bias carriage 60 downward. The upper ends of springs 64 abut washer elements that are secured via threaded fasteners to the guide posts 62. Carriage 60A is controlled by cable 50A and slides vertically on guide posts 62 to permit reservoir 40A to travel up and down. Reservoir 40A is shown in a lower position corresponding to printhead 12A (FIG. 2) which is in the home or operating position. Reservoir 40B is shown in a raised position corresponding to printhead 12B, which is in the priming or servicing position.

Referring to FIG. 4, carriage 60A is secured to wire 52 by a bracket 65 that extends generally horizontally. Wire 52 is fastened to bracket 65 in a known manner, for example, using a tab member attached to the end of wire 52 and interlocked within a recess in bracket 65. The sheath of cable 50 is secured to cross-member 66 which extends upward from base 70 of housing 19 (FIGS. 1 and 2). Suitable adjustment means 68 may be provided to adjust the tension in or effective length of Bowden™ cables 50 in a known manner.

As can be seen in FIGS. 2 and 4, rotational movement of printhead 12 results in translational movement of wire 52 of Bowden™ cable 50 which, in turn, causes translational movement of carriage 60 on guide posts 62. The dimensions of pulley 30 are chosen such that the translational movement of wire 52 equals the elevational change experienced by the printhead orifices as the printhead is rotated.

Other uses and modification of the foregoing embodiments will be apparent to those of ordinary skill without departing from the spirit and scope of the invention. For example, the invention is also applicable to printing systems in which the printhead height, with respect to the transport surface is adjustable. In that case, each printhead is oriented to project droplets substantially horizontally and undergoes linear, rather than rotational, movement as it is adjusted upward or downward relative to the transport surface, for example, in order to accommodate the imaging of containers of different heights. Those of ordinary skill will recognize that the invention may be adapted for use in such situations by securing the Bowden™ cable to the printhead in a suitable manner. The foregoing is therefore intended to illustrate one or more preferred embodiments of the invention and should not be construed as limiting the scope of the invention which is defined in the appended claims.

What is claimed is:

1. A device for maintaining the hydrostatic pressure in an ink jet printhead comprising:

an ink reservoir for containing a supply of ink, the supply of ink having a top level;

a rotation of the printhead having orifices from which droplets are projected, the orifices being disposed at a predetermined elevation with respect to the top level of the ink in the ink reservoir to create a desired hydrostatic pressure;

a flexible conduit for conducting ink from the reservoir to the printhead; and means for lowering and raising the reservoir responsive to the rotation of the printhead, such that the predetermined elevation of the orifices with respect to the top level of the ink is maintained.

2. The device of claim 1, wherein the means for adjusting comprises a cable that is coupled to the printhead such that the rotation of the printhead causes translational movement of the cable.

3. The device of claim 1, further including means for mounting the printhead on a support and means for allowing said printhead to rotate.

4. The device of claim 3, further comprising a pulley coupled to the printhead and wherein the means for adjusting comprises a cable secured to the pulley such that a rotation of the printhead causes translational movement of the cable.

5. The device of claim 4, wherein the reservoir is mounted on a movable carriage which is coupled to the cable.

6. In an ink jet printer, a combination comprising:

an ink reservoir for storing a supply of ink;

a printhead having orifices from which droplets are projected;

a flexible conduit for conducting ink from the reservoir to the printhead;

means for mounting the printhead such that elevation of the orifices is changed; and means for linking the printhead to the reservoir such that changes in elevation of the reservoir correspond to changes in the elevation of the orifices.

7. In an inkjet printing system, a combination comprising:

a printhead with a plurality of orifices for projecting ink droplets toward a substrate;

an ink reservoir containing ink that is coupled to the printhead, said ink having a top level;

means for mounting the printhead such that the printhead is moved between first and second vertical positions, respectively, the printhead being operative to mark the substrate in said first position and being available for servicing in said second position;

means for supporting the reservoir such that the reservoir may move between third and fourth vertical positions, respectively, to maintain hydrostatic ink pressure at the printhead within a predertermined range;

said reservoir in said third position maintaining said hydrostatic ink pressure at the printhead in said first position for marking operation and said reservoir in said fourth position maintaining said hydrostatic ink pressure at the printhead in said second position for servicing of the latter; and means for coupling said printhead mounting means and said reservoir support means responsive to vertical movement of the printhead between the first and second vertical positions, to initiate movement of the reservoir between the third and fourth vertical positions, whereby the printhead orifices and the top level of the ink in the reservoir are maintained within a predetermined range of distances at all times as the printhead is moved between said first and second vertical positions.

8. In an inkjet printing system, a combination comprising: a printhead with a plurality of orifices for projecting ink droplets toward a substrate, an ink reservoir containing ink that is coupled to the printhead, said ink having a top level;

means for mounting the printhead such that the printhead is moved between first and second vertical positions, respectively, the printhead being operative to mark the substrate;

means for supporting the reservoir such that the reservoir may move between third and fourth vertical positions, respectively, to maintain a hydrostatic ink pressure at the printhead within a predetermined range; and means for coupling said printhead mounting means and said reservoir support means responsive to movement of the printhead between the first and second vertical positions to initiate movement of the reservoir between the third and fourth vertical positions, whereby the printhead orifices and the top level of the ink in the reservoir are maintained within a predetermined range of distances at all times as the printhead is moved between said first and second vertical positions.

* * * * *

UNITED STATES PATENT AND TRADEMARK OFFICE

CERTIFICATE OF CORRECTION

PATENT NO. : 5,929,882
DATED : July 27, 1999
INVENTOR(S) : Sharpe, Colin R.

It is certified that error appears in the above-identified patent and that said Letters Patent is hereby corrected as shown below:

Claim 1,
Line 5, change "a rotation of the printhead" to -- a rotable printhead --.

Signed and Sealed this

Fifth Day of February, 2002

*Attest:*

*Attesting Officer*

JAMES E. ROGAN
*Director of the United States Patent and Trademark Office*